US007486241B2

(12) United States Patent
Qi et al.

(10) Patent No.: US 7,486,241 B2
(45) Date of Patent: Feb. 3, 2009

(54) LOW PROFILE FULL WAVELENGTH MEANDERING ANTENNA

(75) Inventors: Yihong Qi, Waterloo (CA); Perry Jarmuszewski, Guelph (CA); Ying Tong Man, Kitchener (CA)

(73) Assignee: Research In Motion Limited, Waterloo, Ontario (CA)

( * ) Notice: Subject to any disclaimer, the term of this patent is extended or adjusted under 35 U.S.C. 154(b) by 0 days.

(21) Appl. No.: 11/014,287

(22) Filed: Dec. 16, 2004

(65) Prior Publication Data

US 2006/0132364 A1 Jun. 22, 2006

(51) Int. Cl.
*H01Q 1/24* (2006.01)

(52) U.S. Cl. ..... 343/702; 343/806; 343/828

(58) Field of Classification Search ..... 343/700 MS, 343/806, 895, 702, 731, 741, 744, 825, 828
See application file for complete search history.

(56) References Cited

U.S. PATENT DOCUMENTS 3,689,929 A * 9/1972 Moody ..... 343/802
5,361,061 A * 11/1994 Mays et al. ..... 340/7.54
5,583,521 A 12/1996 Williams
5,841,403 A * 11/1998 West ..... 343/702
6,147,655 A 11/2000 Roesner
6,351,241 B1 2/2002 Wass
2002/0080088 A1 6/2002 Boyle

FOREIGN PATENT DOCUMENTS

EP 1 189 304 3/2002

* cited by examiner

*Primary Examiner*—Michael C Wimer
(74) *Attorney, Agent, or Firm*—Allen, Dyer, Doppelt, Milbrath & Gilchrist, P.A.

(57) ABSTRACT

A low profile antenna has a meander length based on the full electrical wavelength of the signal being transmitted or received. The antenna can have either an open-loop structure or a closed-loop structure with a matching network. The low profile enables the antenna to be used in a card for a device such as a personal computer, personal digital assistant, wireless telephone and so on with minimal risk of the antenna breaking off, as compared with a prior art antenna having a higher height and thus more likelihood of being broken from its card.

17 Claims, 10 Drawing Sheets

LOW PROFILE FULL WAVELENGTH MEANDERING ANTENNA

BACKGROUND OF THE INVENTION

The present invention relates to a low-profile antenna for use in mobile computing devices, and more particularly, to an antenna having a meandering configuration.

Various configurations have been proposed for antennas used in mobile computing devices.

FIG. 1 shows a portion of a Personal Computer Memory Card International Association (PCMCIA) card having a wireless modem. U.S. Pat. No. 5,373,149, assigned to AT&T Bell Laboratories, shows circuit card 76 having located thereon battery 80, antenna 82, infra-red transceiver 84, transmit/receive electronics 86 and electrical contacts 92. Antenna 82 depends on circuit card 76 to radiate. Since the personal computer used with the wireless modem also naturally radiates energy, the personal computer and the wireless modem interfere with each other.

FIG. 2 shows an end of a PCMCIA wireless modem package opposite the end inserted into a PCMCIA slot of a computing device. U.S. Pat. No. 5,583,521, assigned to GEC Plessey Semiconductors, Inc., shows PCMCIA package 3 with transparent containment 5 (suggested in phantom) that contains a low profile, paired L-shape antenna system including vertical legs 6*a*', 6*b*' and horizontal legs 6*a*", 6*b*" made of copper wire and separated in a diversity pattern. Horizontal legs 6*a*", 6*b*" meander in a horizontal plane within transparent containment 5. The antenna system avoids use of a conventional monopole whip antenna that cannot readily fit into a low profile enclosure. Shielded package 3 acts as a ground plane system for the antenna system.

FIG. 3 shows an extendable whip antenna for use in a mobile telephone having a radiating element with a meandering and cylindrical configuration. U.S. Pat. No. 6,351,241, assigned to Allgon AB, shows elongated dielectric portion 30 having a length essentially equal to the length of cylindrically configured meander element 35. Impedance matching means 32 connects to a feed point of meander element 35, is integrated on dielectric carrier 33, and includes contacts at its base for connection to signal and ground connectors of the telephone. As compared to a helical antenna, the meander antenna provides a greater bandwidth, improved production tolerances leading to less rejections, a lower degree of coupling to any adjacent radiators greatly improving multi-band operability and integration of a matching network using at least partly the same manufacturing technique. Unfortunately, as mentioned, the whip antenna cannot fit into a low-profile package.

Since the wireless modem, as well as the personal computer used with the wireless modem, naturally radiates energy, the personal computer and the wireless modem interfere with each other. Accordingly, it is desirable to provide a wireless modem in a low-profile package that is more immune to interference from the computing device with which the wireless modem is used.

SUMMARY OF THE INVENTION

In accordance with an aspect of this invention, there is provided an antenna, comprising a first portion having a meandering path and two ends, and second and third portions, each having a straight path and connected to respective ends of the first portion.

In some cases, the meander length is based on the full electrical wavelength of a signal being transmitted or received. The antenna may have an open-loop configuration, or a closed-loop configuration and a matching network coupled to the second and third portions. The antenna typically has a low-profile configuration, the first portion being horizontal, and the second and third portions being vertical. The antenna has an average gain of −2.5 dBi or better, and a peak gain of 0.1 dBi or better.

In some cases, the antenna also has fourth and fifth portions each having a meandering path, the fourth portion connected to the second portion, the fifth portion connected to the third portion, so that the first, second, third, fourth and fifth portions are in series.

In accordance with another aspect of this invention, there is provided an open-loop antenna, comprising first, second, third, fourth and fifth portions connected serially. The first, third and fifth portions have meandering paths, and the fifth portion is coupled to a current source or transceiver.

In accordance with a further aspect of this invention, there is provided a closed-loop antenna, comprising a matching network that is coupled to a current source or transceiver, and first, second, third, fourth and fifth portions connected serially. The first, third and fifth portions have meandering paths, and the first and fifth portions are connected to the matching network.

It is not intended that the invention be summarized here in its entirety. Rather, further features, aspects and advantages of the invention are set forth in or are apparent from the following description and drawings.

DETAILED DESCRIPTION

A low profile antenna has a meander length based on the full electrical wavelength of the signal being transmitted or received. The antenna can have either an open-loop structure or a closed-loop structure with a matching network.

As used herein, "low profile" means having a height that is generally less than the height of the device, such as a personal computer, to which the antenna including the circuit board for the antenna is coupled, and without an extendable whip antenna.

The low profile enables the antenna to be used in a card for a device such as a personal computer, personal digital assistant, wireless telephone and so on with minimal risk of the antenna breaking off, as compared with a prior art antenna having a higher height and thus more likelihood of being broken from its card.

The low profile antenna is carefully designed so that it avoids using its card as a radiator, that is, its radiation pattern is based on the low profile antenna and not associated structures such as the card or the device that the card is used with.

Figure 1:
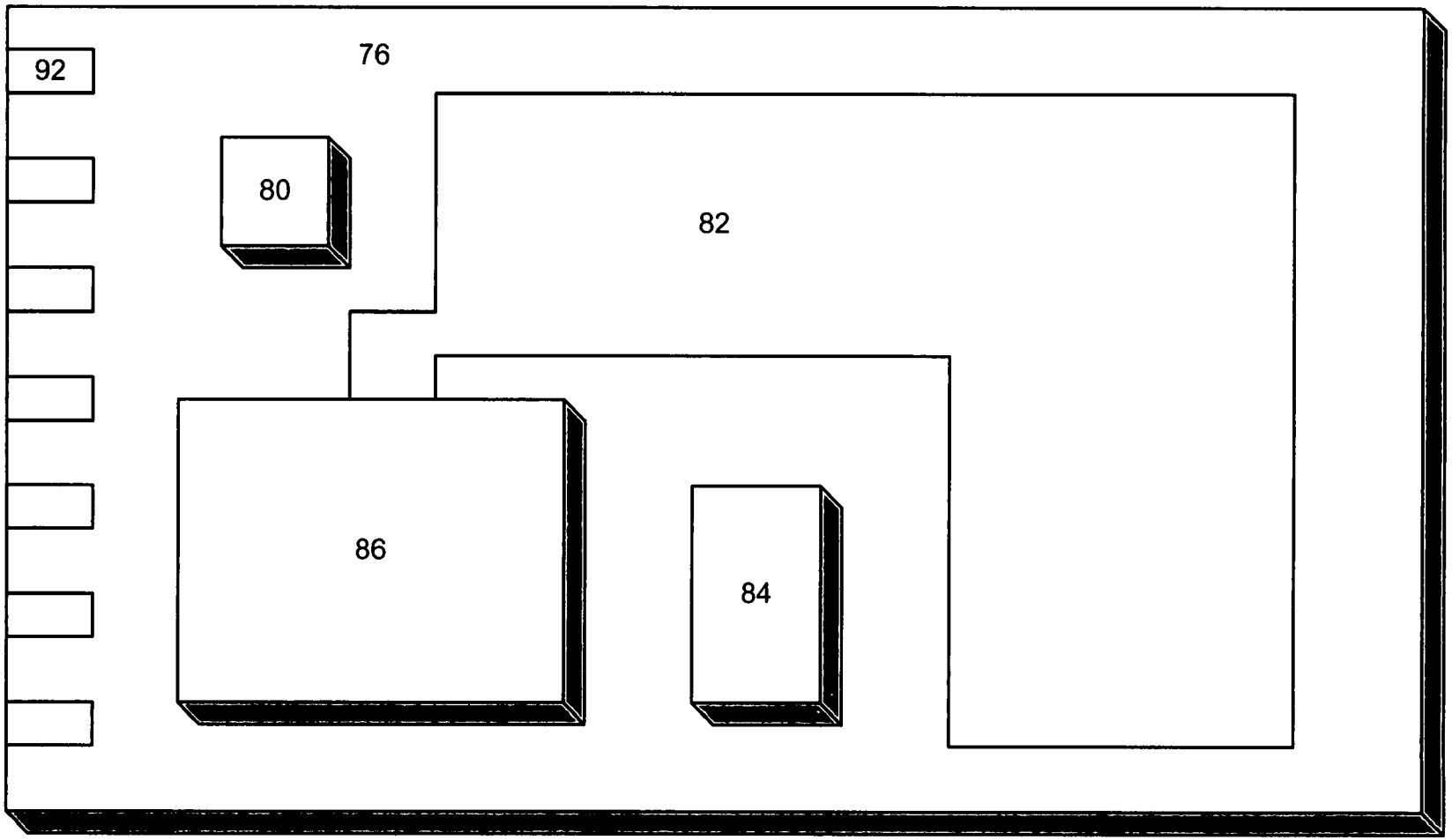
Fig. 1 (Prior Art)
FIG. 1 is a diagram showing a PCMCIA card with an antenna element that depends on the circuit card to radiate.
Figure 3:
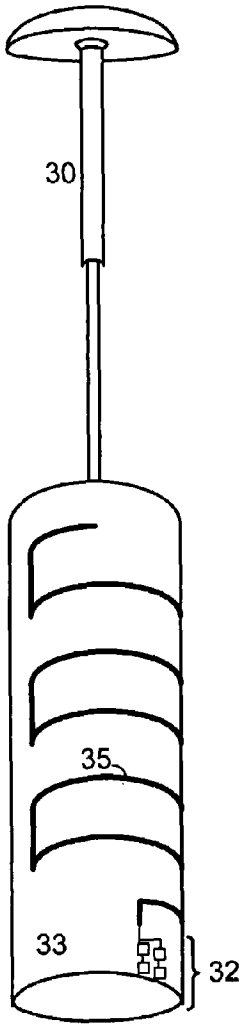
Fig. 3 (Prior Art)
FIG. 3 is a diagram showing a whip antenna with a radiating element having a meandering and cylindrical configuration.
Figure 2:
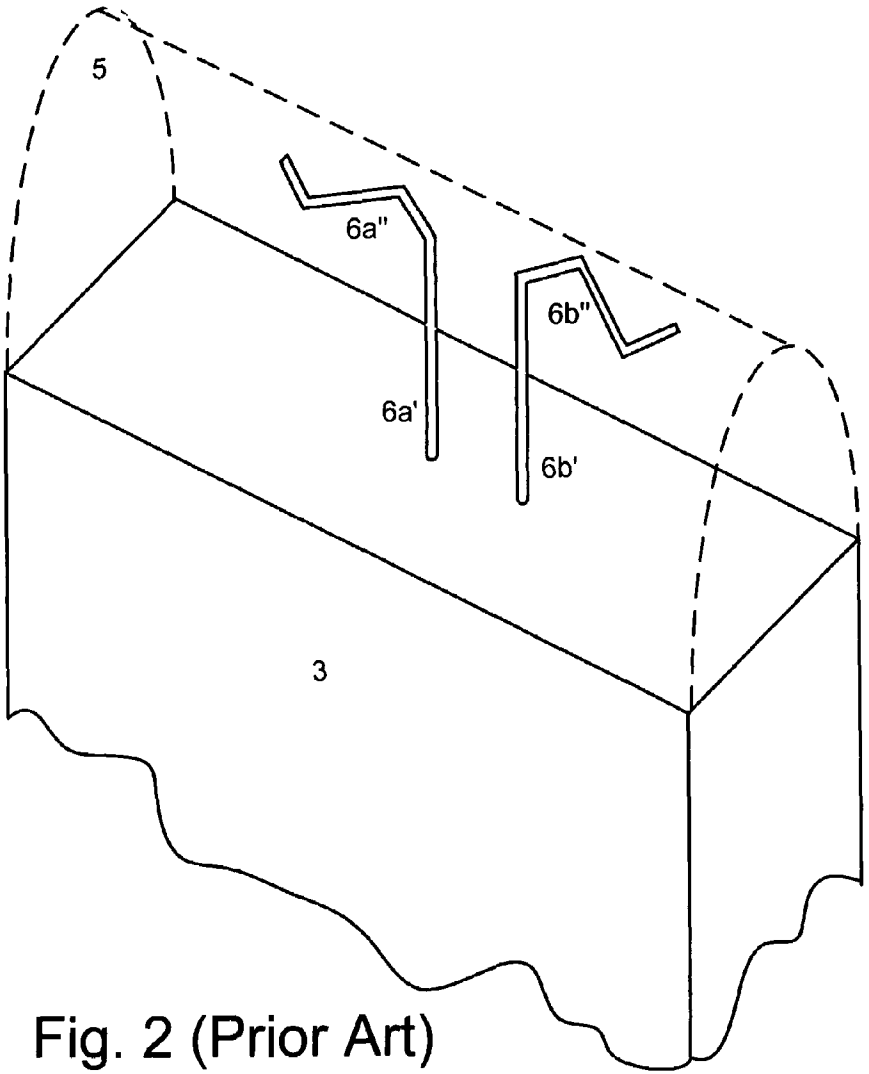
Fig. 2 (Prior Art)
FIG. 2 is a diagram showing a PCMCIA card with a meandering antenna projecting from an end of the PCMCIA package and which depends on the circuit card to radiate.
Figure 4A:
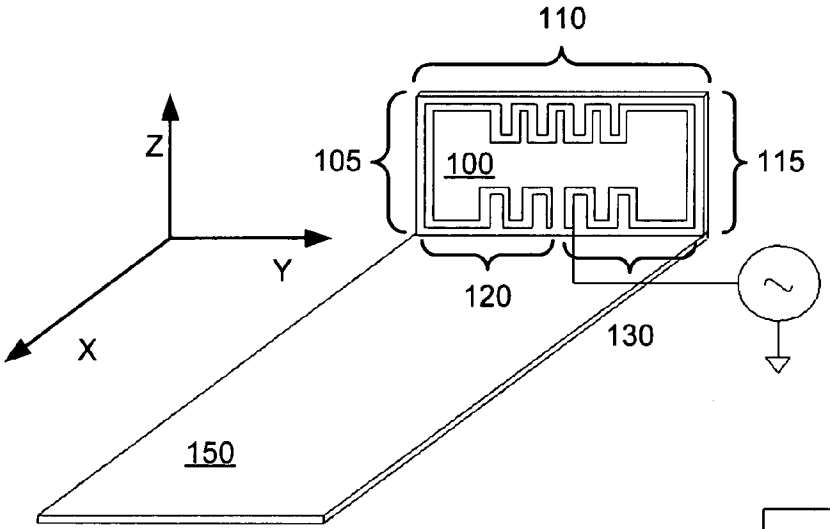
FIGS. 4A and 4B are diagrams showing an open-loop antenna.

FIG. 4A shows open-loop antenna 100 in a fixed (non-rotatable) position on PCMCIA card 150 having side portions 105, 115, top portion 110, bottom left portion 120 and bottom right portion 130. Side portions 105, 115 have straight paths. Top and bottom portions 110, 120, 130 each have at least one straight path segment and a meandering path segment. Bottom left portion 120 has a floating end. Bottom right portion 130 is coupled to a current source or transceiver.

In other embodiments, side portions 105, 115 have meandering paths.

Open loop antenna 100 is perpendicular to PCMCIA card 150. Open-loop antenna 100 has a generally rectangular shape with four sides. The first and third sides of open-loop antenna 100 are perpendicular to an edge of PCMCIA card 150. The second and fourth sides of open-loop antenna 100 are parallel to an edge of PCMCIA card 150. Side portion 105 is located along the first side of the generally rectangular shape of open-loop antenna 100. Top portion 110 is located along the second side of the generally rectangular shape of open-loop antenna 100. Side portion 115 is located along the third side of the generally rectangular shape of open-loop antenna 100. Bottom left portion 120 and bottom right portion 130 are located along the fourth side of the generally rectangular shape of open-loop antenna 100. The height of the meandering paths of portions 110, 120, 130 is a fixed amount along the entirety of the meandering paths.

Open-loop antenna 100 generally has a width that is determined by the width of PCMCIA card 150, and a height that is about one-half of its width. Increasing the height of open-loop antenna 100 reduces the length of the meander portions needed to obtain a full wavelength, thereby allowing more current to flow in the vertical direction and increasing the antenna's efficiency.

Figure 4B:
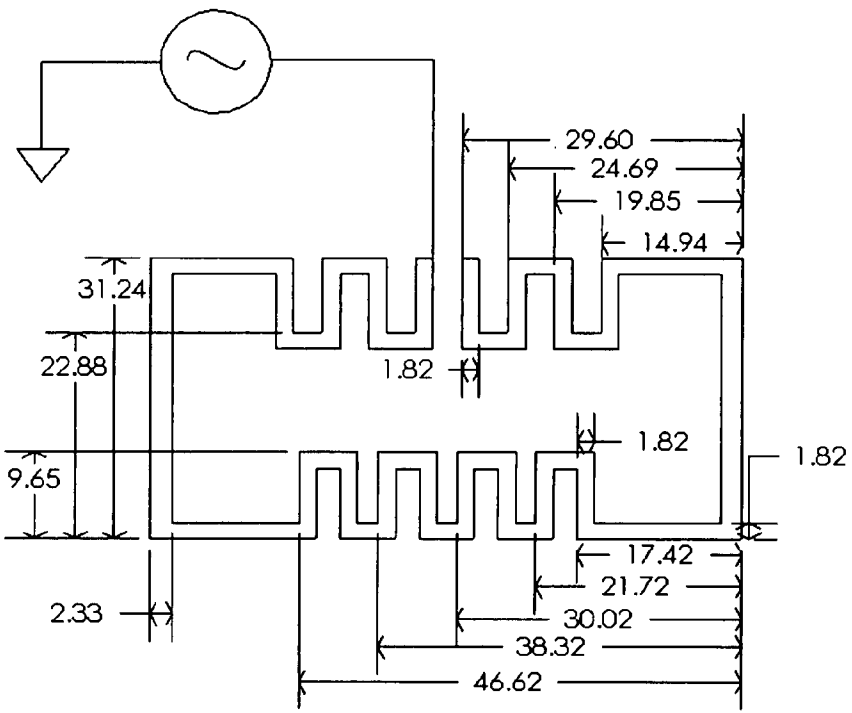
Figure 5A:
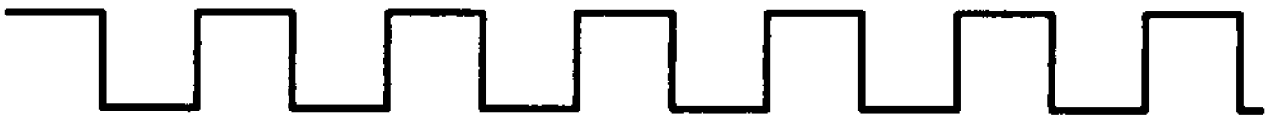
FIGS. 5A-5C are diagrams showing different meander configurations.
Figure 5B:
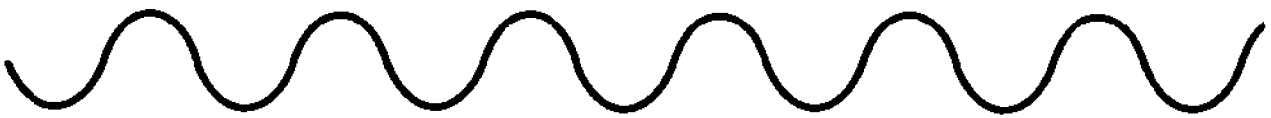
Figure 5C:
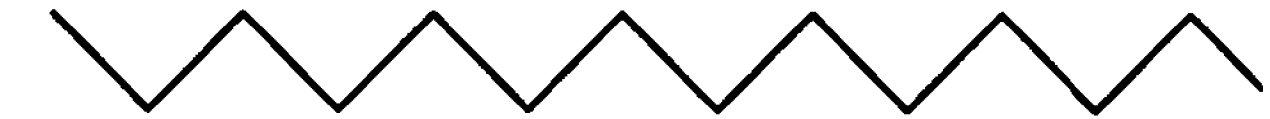

FIG. 4B shows measurements of open-loop antenna 100 in mm. Its overall width is seen to be about 64 mm and its height is about 32 mm. Top portion 110 has a first straight path segment that is 17.42 mm, a meandering path segment that is 46.62−17.42=29.20 mm, and a second straight path segment that is about 64−46.62=17.38 mm. Each straight path segment is about 14.4/64=27% of the length of top portion 110, while the meandering path segment is about 29.2/64=46% of the length of top portion 110. Each of bottom left portion 120 and bottom right portion 130 has a length of about 29.40 mm, with a straight path segment of about 14.94 mm and a meandering path segment of about 14.66 mm. The meandering path segment is about 14.66/29.4=50% of the length of the respective portion 120, 130. FIGS. 5A-5C show different meander configurations: a Roman key-type meander, a sinusoidal meander and a sawtooth meander. The meander sections are electrical delay lines and could be any shape such as those shown in FIGS. 5A-5C, an inverted Ω shape, and so on.

Figure 6A:
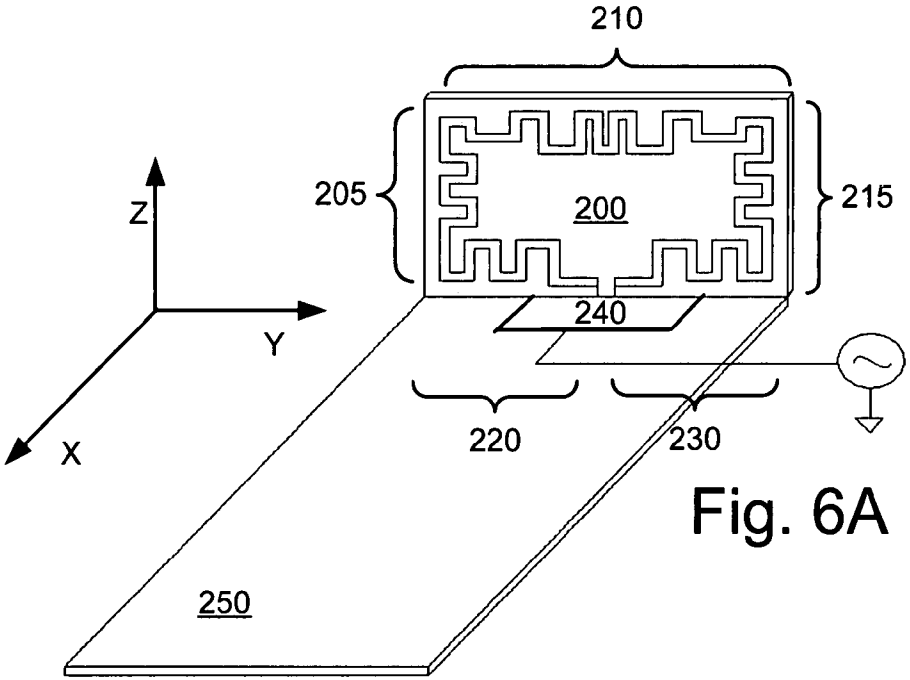
FIGS. 6A and 6B are diagrams showing a closed-loop antenna.

FIG. 6A shows closed-loop antenna 200 on PCMCIA card 250 having side portions 205, 215, top portion 210, bottom left portion 220 and bottom right portion 230. All of portions 205, 215, 210, 220, 230 have meandering paths. Bottom left portion 220 and bottom right portion 230 are coupled to matching network 240, which is coupled to a current source or transceiver.

In other embodiments, side portions 205, 215 have straight, non-meandering paths.

Figure 6B:
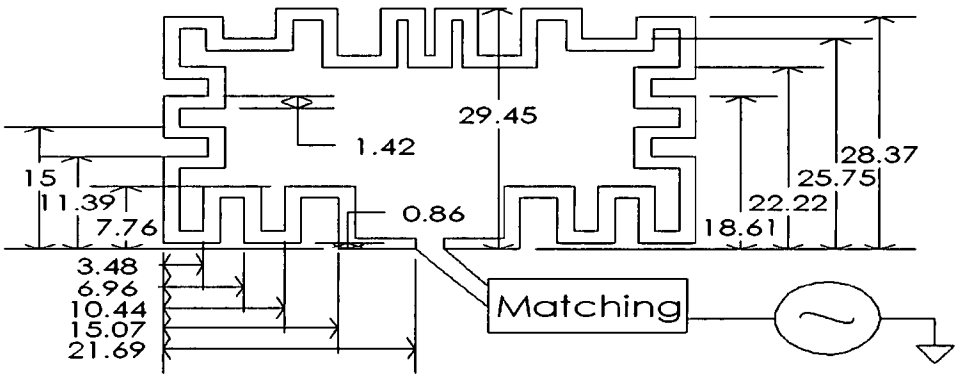

Matching network 240 is designed to match antenna 200 to a typical 50 ohm load presented by the source or transceiver that antenna 200 is coupled to. A typical matching network is a T-type or Pi-type, known to those of ordinary skill in the art of antenna design. FIG. 6B shows measurements of closed-loop antenna 200 in mm. Its overall width is seen to be about 42 mm and its height is about 30 mm.

Figure 7B:
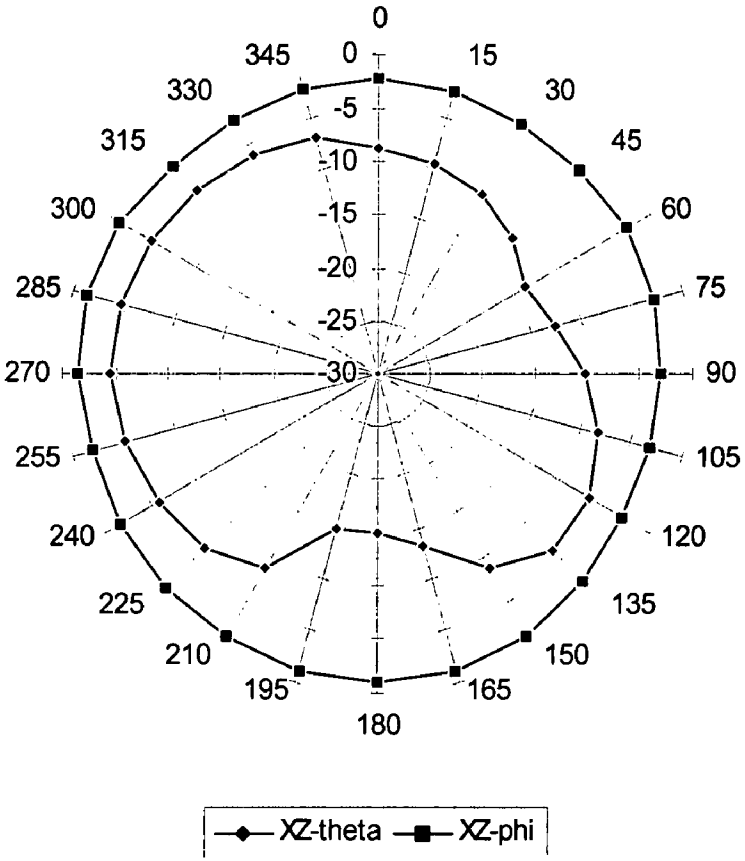
FIGS. 7A-7C are antenna gain patterns for the open-loop antenna in the XY, XZ and YZ planes, respectively.
Figure 7A:
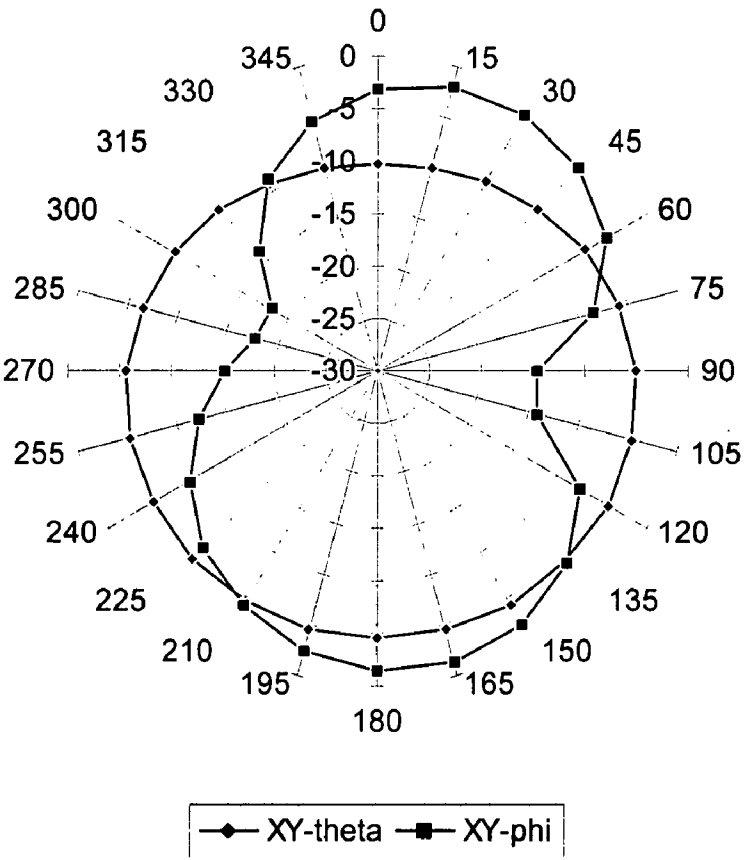
Figure 7C:
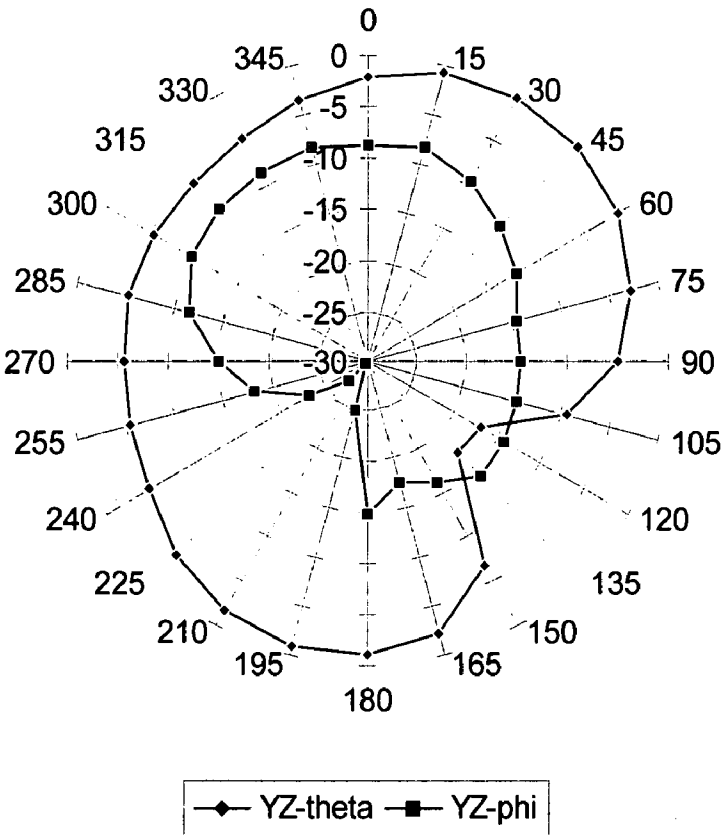

FIGS. 7A-7C are antenna gain patterns for open-loop antenna 100 in the XY, XZ and YZ planes, respectively, for a signal at 915 MHz. The peak antenna gain is 0.59 dBi. The average gain is −2.11 dBi. The X-plane corresponds to the long dimension of card 150. The Y-plane corresponds to the short dimension of card 150. The Z-plane corresponds to the height of card 150. Theta and phi refer to (r, θ, ϕ) spherical coordinates, instead of (x, y, z) Cartesian coordinates. It will be recalled that a gain of −3 dBi corresponds to half of the signal energy being dissipated, whereas a gain of −2 dBi means less than half of the signal energy is dissipated.

Figure 8A:
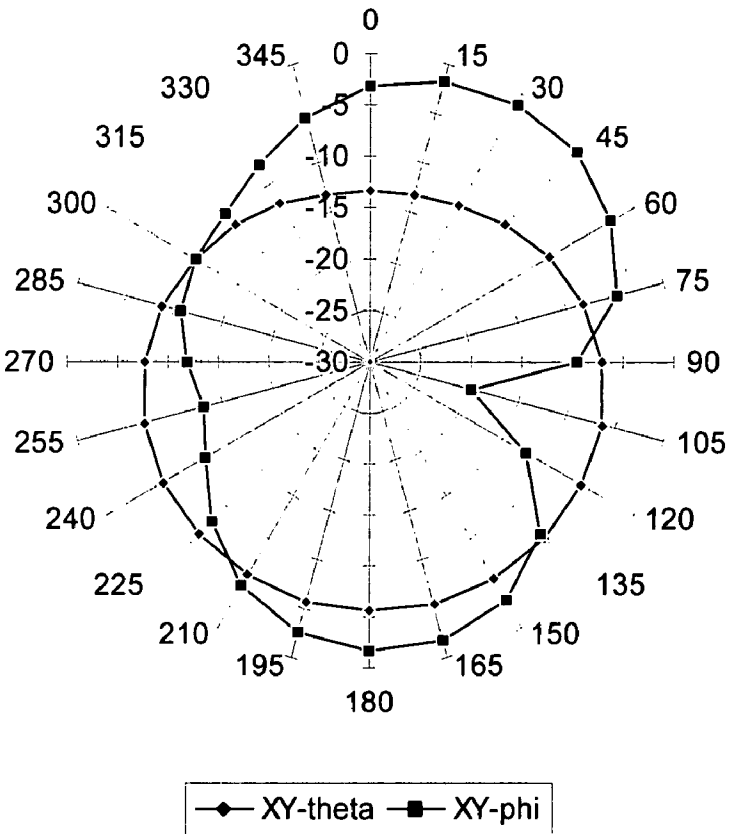
FIGS. 8A-8C are antenna gain patterns for the closed-loop antenna in the XY, XZ and YZ planes, respectively.
Figure 8C:
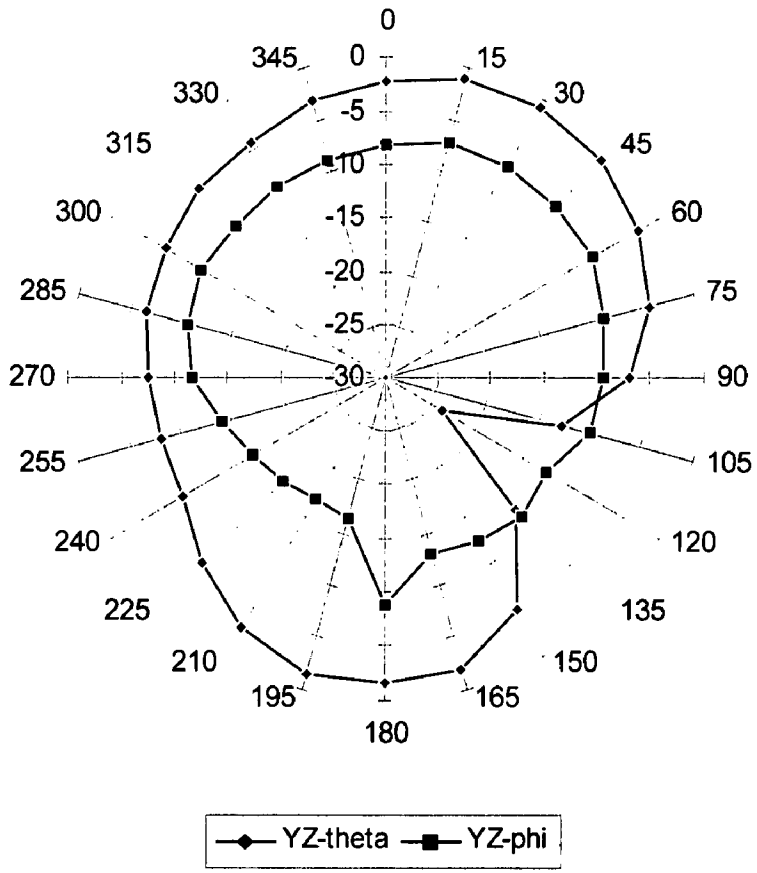
Figure 8B:
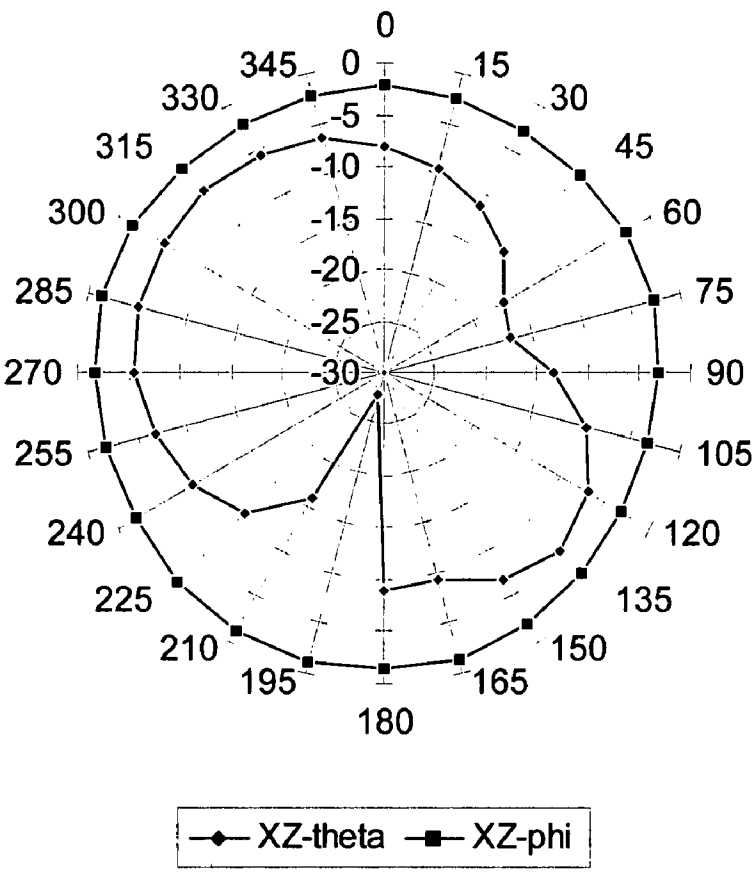

FIGS. 8A-8C are antenna gain patterns for closed-loop antenna 200 in the XY, XZ and YZ planes, respectively, for a signal at 915 MHz. The antenna gain is 0.19 dBi. The average gain is −2.42 dBi.

Figure 9:
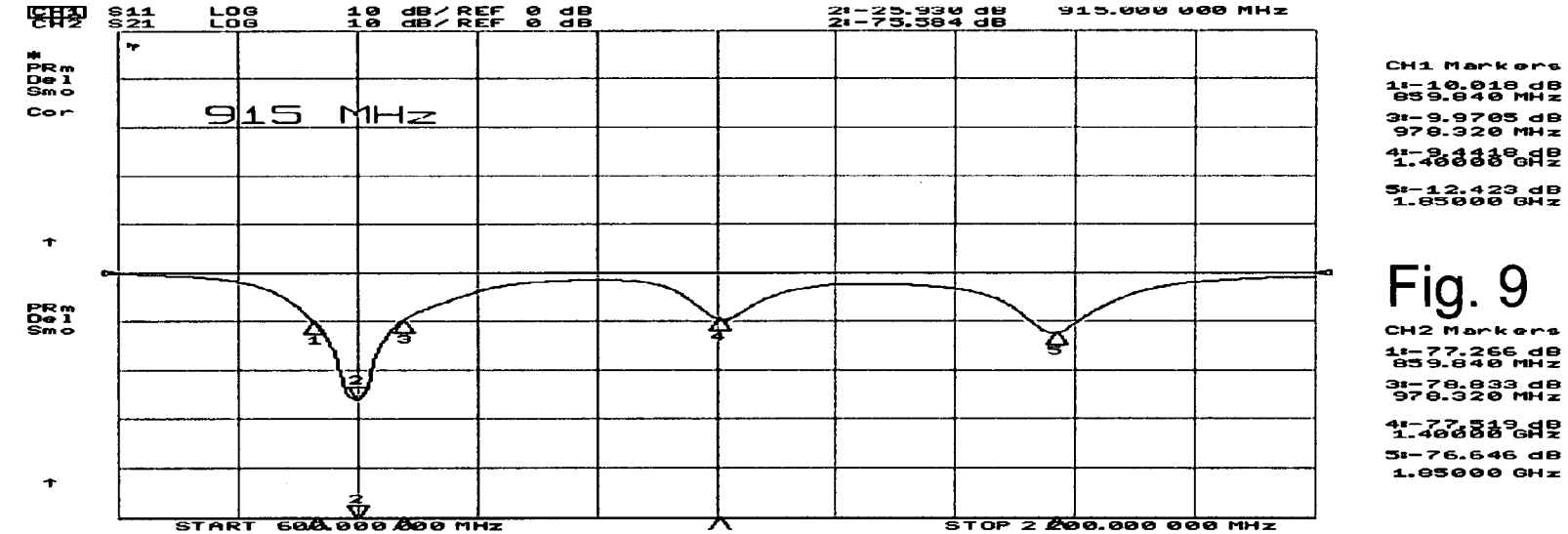
FIG. 9 shows return loss for the open-loop antenna.

FIG. 9 shows return loss for open-loop antenna 100.

Figure 10:
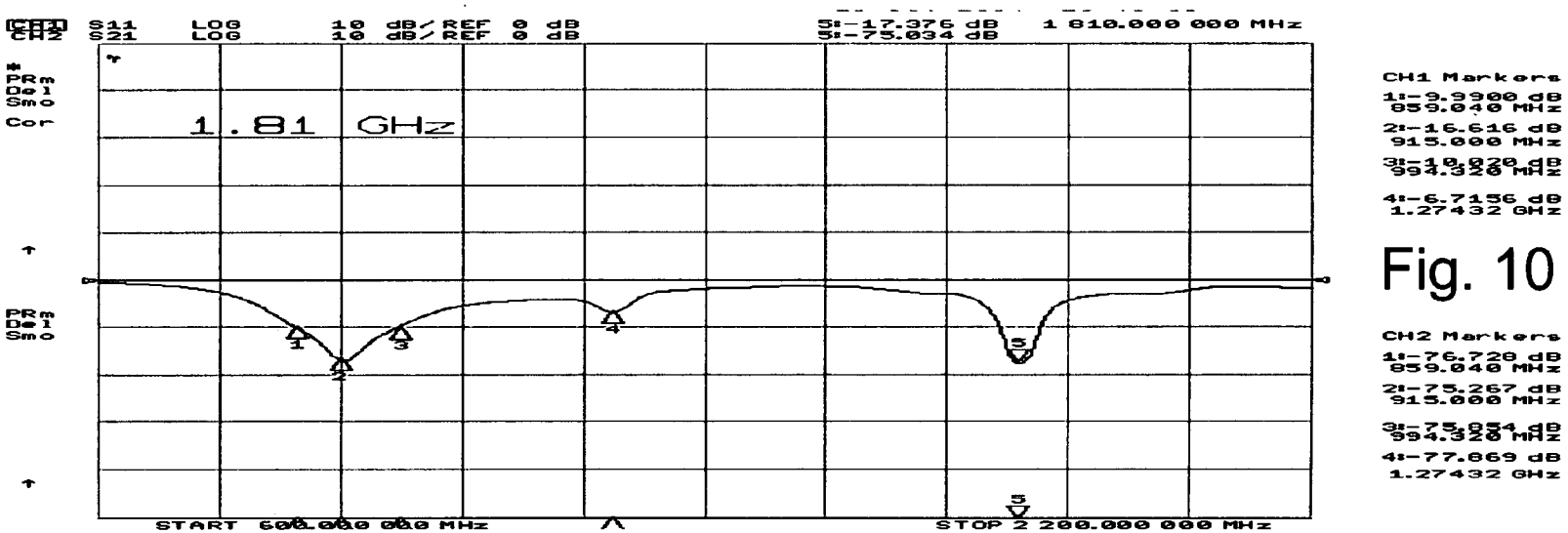
FIG. 10 shows return loss for the closed-loop antenna.

FIG. 10 shows return loss for closed-loop antenna 200.

Figure 11:
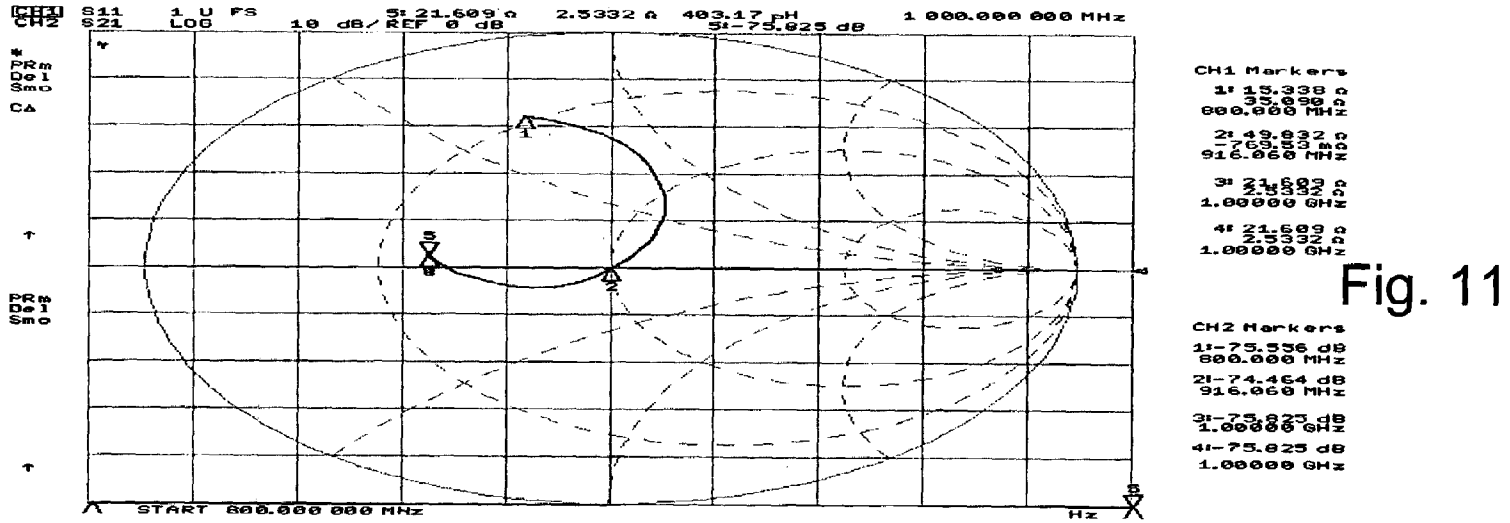
FIG. 11 shows impedance for the open-loop antenna.

FIG. 11 shows impedance for open-loop antenna 100.

Figure 12:
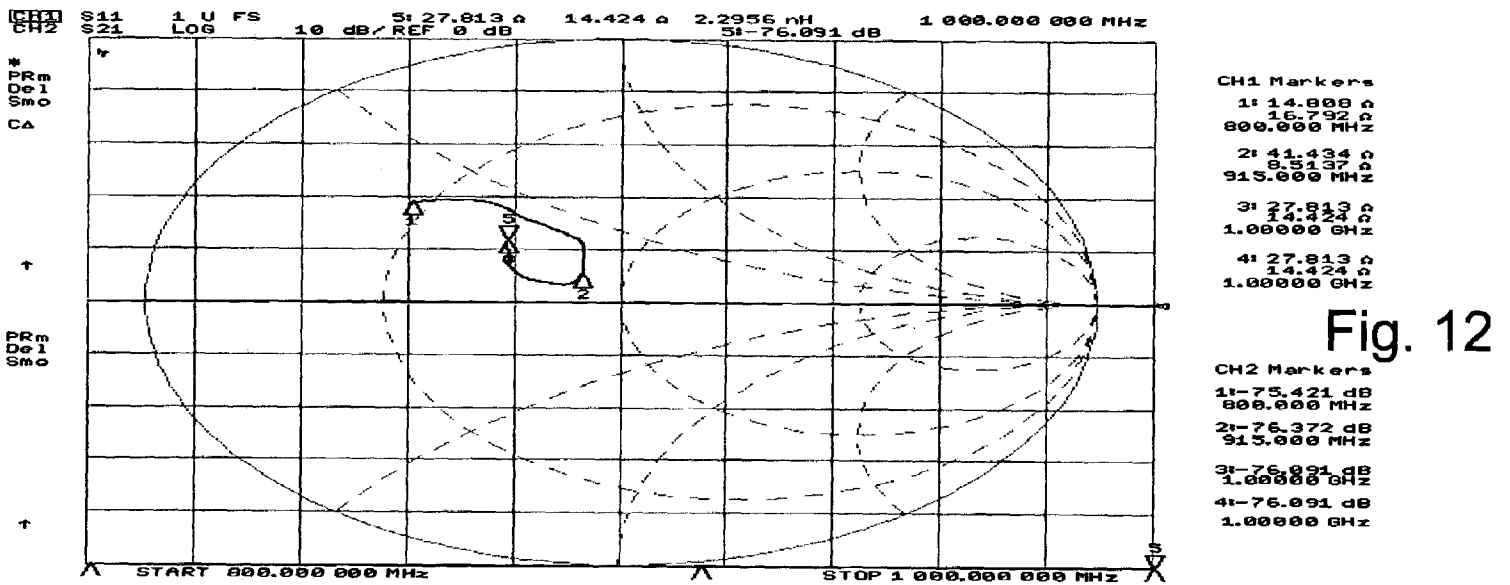
FIG. 12 shows impedance for the closed-loop antenna.

FIG. 12 shows impedance for closed-loop antenna 200.

Although illustrative embodiments of the present invention, and various modifications thereof, have been described in detail herein with reference to the accompanying drawings, it is to be understood that the invention is not limited to these precise embodiments and the described modifications, and that various changes and further modifications may be effected therein by one skilled in the art without departing from the scope or spirit of the invention as defined in the appended claims.

What is claimed is:

1. A card that interfaces an electronic device wherein the electronic device has a device height comprising:

a card body having a width and opposing ends and a device end adapted to engage the electronic device across the width of the card body;

a loop antenna mounted perpendicular on the end opposite the device end, wherein the width of the loop antenna is about the width of the card body and a height about one-half of its width less than the device height, wherein the loop antenna further comprises:

a first portion having a first straight path segment followed by a meandering path segment followed by a second straight path segment, and two ends, the meandering path segment being about 50% of the length of the first portion, and second and third portions, each having a straight path and connected to respective ends of the first portion, wherein the antenna, is non-rotatable relative to the card, and has a generally rectangular shape with four sides, and the first, second and third portions are located along respective sides of the antenna, and the antenna has an antenna height that is less than the device height wherein said meandering path segment is split and a portion engages adjacent said card body and has a floating end and other end coupled to a current source or transceiver and operative as electrical delay lines and a full wavelength antenna.

2. The antenna of claim 1, wherein the meandering path segment has a length based on the full electrical wavelength of a signal being transmitted or received.

3. The antenna of claim 1, having an open-loop configuration.

4. The antenna of claim 1, having a closed-loop configuration and a matching network coupled to the second and third portions.

5. The antenna of claim 1, wherein the first portion is parallel to an edge of the card.

6. The antenna of claim 1, wherein the second and third portions are perpendicular to an edge of the card.

7. The antenna of claim 1, having an average gain of −2.5 dBi or better.

8. The antenna of claim 1, having a peak gain of 0.1 dBi or better.

9. The antenna of claim 1, further comprising fourth and fifth portions each having a meandering path, the fourth portion connected to the second portion, the fifth portion connected to the third portion, so that the first, second, third, fourth and fifth portions are in series.

10. The antenna of claim 9, wherein the fourth and fifth portions are located along a fourth side of the antenna.

11. The antenna of claim 1, wherein the meandering path segment has a configuration that is one of a roman key-type meander, a sinusoidal meander, a sawtooth meander and an inverted Ω meander.

12. A card that interfaces an electronic device wherein the electronic device has a device height comprising:

a card body having a width and opposing ends and a device end adapted to engage the electronic device across the width of the card body;

a loop antenna mounted perpendicular on the end opposite the device end, wherein the width of the loop antenna is about the width of the card body and a height about one-half of its width less than the device height, wherein the loop antenna further comprises:

first, second, third, fourth and fifth portions connected serially, the first, third and fifth portions each having at least one straight path segment and one meandering segment with a fixed meander height along the length of the meandering path segment, the length of each meandering path segment being about 50% of the length of its respective portion, and the fifth portion being coupled to a current source or transceiver, wherein the open-loop antenna is perpendicular to the card, is non-rotatable relative to the card, and has a generally rectangular shape with four sides, and the first and fifth portions are located along the first side of the open-loop antenna, the second portion is located along the second side of the open-loop antenna, the third portion is located along the third side of the open-loop antenna, and the fourth portion is located along the fourth side of the open-loop antenna, wherein said meandering path segment is split and a portion engages adjacent said card body and has a floating end and other end coupled to a current source or transceiver and operative as electrical delay lines and a full wavelength antenna.

13. The open-loop antenna of claim 12, wherein the first, third and fifth portions are parallel to an edge of the card.

14. The open-loop antenna of claim 12, wherein the second and fourth portions are perpendicular to an edge of the card.

15. The open-loop antenna of claim 12, wherein the second and fourth portions have meandering paths.

16. The open-loop antenna of claim 12, having an average gain of −2.5 dBi or better.

17. The open-loop antenna of claim 12, wherein the second and fourth portions have straight paths.

* * * * *

UNITED STATES PATENT AND TRADEMARK OFFICE

CERTIFICATE OF CORRECTION

PATENT NO. : 7,486,241 B2
APPLICATION NO. : 11/014287
DATED : February 3, 2009
INVENTOR(S) : Qi et al.

It is certified that error appears in the above-identified patent and that said Letters Patent is hereby corrected as shown below:

| | |
|---|---|
| Column 6, Line 26 | Delete: "The open-loop antenna"<br>Insert: --The card-- |
| Column 6, Line 28 | Delete: "The open-loop antenna"<br>Insert: --The card-- |
| Column 6, Line 30 | Delete: "The open-loop antenna"<br>Insert: --The card-- |
| Column 6, Line 32 | Delete: "The open-loop antenna"<br>Insert: --The card-- |
| Column 6, Line 34 | Delete: "The open-loop antenna"<br>Insert: --The card-- |

Signed and Sealed this

Fourteenth Day of April, 2009

John Doll

JOHN DOLL
*Acting Director of the United States Patent and Trademark Office*